US006761014B2

(12) United States Patent
Cerf

(10) Patent No.: US 6,761,014 B2
(45) Date of Patent: Jul. 13, 2004

(54) APPARATUS AND PROCESS FOR WRAPPING ARTICLES ON A CONVEYER

(76) Inventor: Alain Cerf, 3301 Gateway Blvd., St. Petersburg, FL (US) 33782

( * ) Notice: Subject to any disclaimer, the term of this patent is extended or adjusted under 35 U.S.C. 154(b) by 0 days.

(21) Appl. No.: 10/219,766

(22) Filed: Aug. 16, 2002

(65) Prior Publication Data

US 2004/0031242 A1 Feb. 19, 2004

(51) Int. Cl.[7] ..... B65B 53/02

(52) U.S. Cl. ..... 53/442; 53/209; 53/228; 53/389.2; 53/466; 53/557

(58) Field of Search ..... 53/209, 228, 463, 53/466, 389.2, 389.3, 557, 230, 231, 232

(56) References Cited

U.S. PATENT DOCUMENTS

| | | | | | |
|---|---|---|---|---|---|
| 2,894,363 | A | * | 7/1959 | Voogd | 53/228 |
| 3,546,836 | A | * | 12/1970 | Buob et al. | 53/461 |
| 3,604,182 | A | * | 9/1971 | Jepsen | 53/528 |
| 3,791,100 | A | * | 2/1974 | Monaghan | 53/74 |
| 4,167,841 | A | * | 9/1979 | Camp | 53/399 |
| 4,388,796 | A | * | 6/1983 | Zelnick | 53/441 |
| 4,499,706 | A | * | 2/1985 | Scheller | 53/399 |
| 4,509,314 | A | * | 4/1985 | Bozza | 53/586 |
| 4,628,664 | A | * | 12/1986 | Price | 53/232 |
| 4,662,148 | A | * | 5/1987 | Nilsson | 53/399 |
| 4,706,444 | A | * | 11/1987 | Gambetti | 53/557 |
| 4,738,078 | A | * | 4/1988 | Benz et al. | 53/439 |
| 4,991,376 | A | * | 2/1991 | Backman | 53/399 |
| 6,085,487 | A | * | 7/2000 | De Vlaam | 53/176 |
| 6,223,500 | B1 | * | 5/2001 | Kramps | 53/399 |
| 6,282,868 | B1 | * | 9/2001 | Vlaam | 53/399 |
| 6,318,053 | B1 | * | 11/2001 | Frank et al. | 53/586 |

* cited by examiner

*Primary Examiner*—Stephen F. Gerrity
*Assistant Examiner*—Hemant M. Desai
(74) *Attorney, Agent, or Firm*—Sam Silverberg

(57) ABSTRACT

An apparatus for wrapping articles comprising a clamp for pulling a film, a first conveyor for moving an article to a second conveyor, a second conveyor, an opening between the first and second conveyor to allow the clamp to pull the film through the opening. A shear located below the first and second conveyors. Feeding an end of the film to the clamp and seizing the end of the film by the clamp below the conveyors. Pulling the film by moving the clamp with the seized end of the film through the opening to a position above the conveyors that would allow the film to wrap the article with an overlap. Cutting the film with the shear after the clamp reached in the position above the conveyors. Wrapping the article by moving the clamp with the seized film from the position above the conveyors through the opening to a second position below the conveyors and releasing the seized film, and overlapping the cut end and the released end of the film wherein the overlap is between the conveyor and bottom of the article.

17 Claims, 5 Drawing Sheets

APPARATUS AND PROCESS FOR WRAPPING ARTICLES ON A CONVEYER

FIELD OF INVENTION

The invention relates to an apparatus or process for wrapping an article with a web. In particular the web is a heat shrinkable material.

BACKGROUND OF THE INVENTION

Machines for moving an article or groups of articles through the plane of a continuous film, wrapping the article or articles with the film, sealing and severing the film, and than shrinking the film around the article or articles, are exemplified by U.S. Pat. Nos. 5,046,600; 4,870,802; 4,365,456; 4,319,443; 4,706,444; 4,341,057 and 3,191,356. These patents are incorporated by reference. Basically, such machines provide a generally horizontal conveyor for moving the articles along a path. A film is vertically extended across the path of the articles from supply rolls above and below. As leading edge of the articles is moved through the plane of the film each roll rotates thereby supplying additional film that wraps the articles. As each article displaces the film a portion of the film drawn from below and another portion of the film drawn from above, cover the front and top of the article. A moving bar pulls the film from above behind the article thereby wrapping the article. After wrapping the article, the film is sealed and severed behind the article. The film is sealed across the width of the film along two spaced lines and is severed between the lines. This results in a wrapped article, which is separated from the remaining film. The remaining film is united to the upper and lower rolls by the seal so that the next article or group of articles can intercept the film. Then the wrapped article is moved through a heated tunnel to shrink the film.

U.S. Pat. No. 4,706,444 shows using wrapping bars where the final end portion of the wrapping material is folded over the article by the movement of a conveyor. The article is moved on the film by pushing the article onto the film.

These machines shown in these references are both expensive and complex. This invention reduces the complexity of wrapping an article with a film by providing a machine that is simple to operate and inexpensive to construct. An article can include a number of items that are bundled together to be wrapped.

DETAILED DESCRIPTION OF THE INVENTION

Referring to FIGS. 1 through 4, an article 1 is moved along from conveyors A to B. Conveyors A and B move at approximately the same speed and in the same direction. As article 1 moves to conveyor B a clamp 2 pulls a film 3 from below the conveyors through an opening between conveyor A and B to a position shown in FIG. 1 that would intercept the movement of article 1 from conveyor B to conveyor A. The shear cuts the film below the conveyors. The amount of film cut is determined by the size of the article to allow wrapping and overlap of the ends of the film 3. As article 1 moves to conveyor A, the film 3 wraps the bottom of the article 1 thereby pinching the film between the bottom of the article 1 and conveyor A. Concurrently the clamp moves down through the opening between the conveyors A and B thereby wrapping the trailing face of the article with film 3. When the clamp 2 moves below the conveyors the clamp releases the film. The movement of the conveyors is reversed. This causes the released end of the film to overlap the pinched film and become trapped between the pinched film and conveyor B. Clamp 2 moves into position to pull film through conveyors A and B when another article moves to conveyor B. At a later station the overlap portions are fused together.

Figure 1:
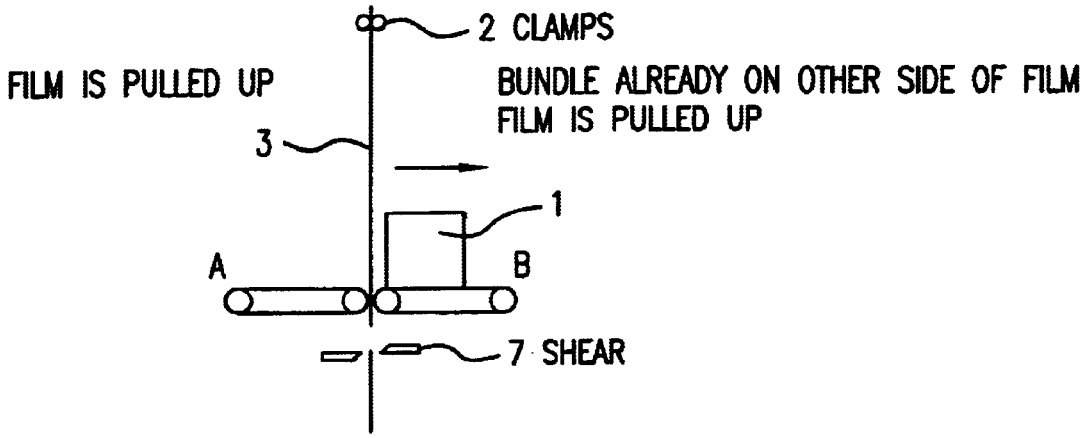
FIG. 1 shows a clamp pulling a film after the article as moved passed the opening between the conveyors.
Figure 2:
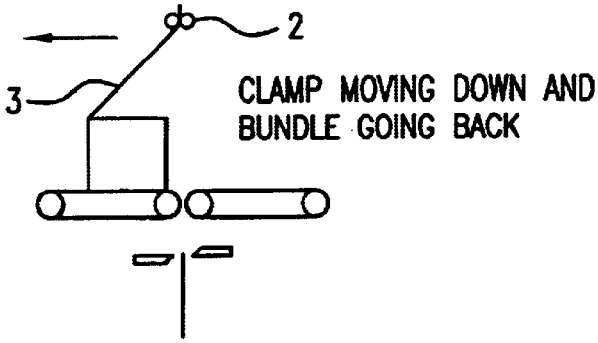
FIG. 2 shows the clamp wrapping the article after the article moves back into the plane of the film.
Figure 3:
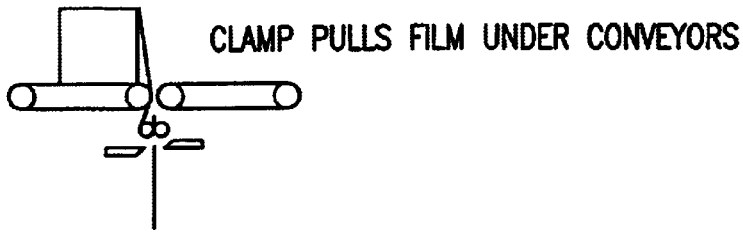
FIG. 3 shows the clamp pulling the film below the conveyors.
Figure 4:
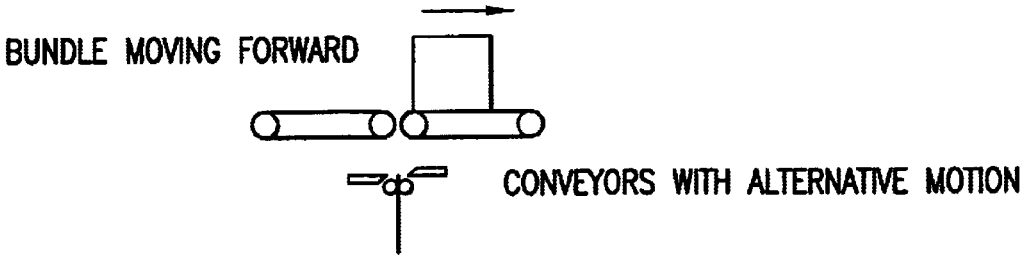
FIG. 4 shows the article moving forward to pinch the released end of the film to create an overlap.
Figure 5:
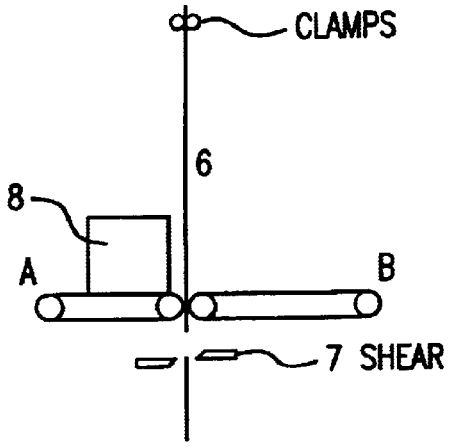
FIG. 5 shows a clamp pulling a film before the article moves pass the opening between the conveyors.
Figure 6:
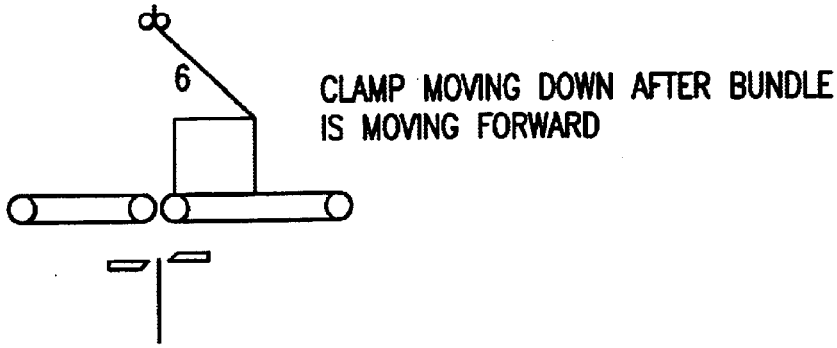
FIG. 6 shows the clamp wrapping the article after the article moves into the plane of the film.
Figure 7:
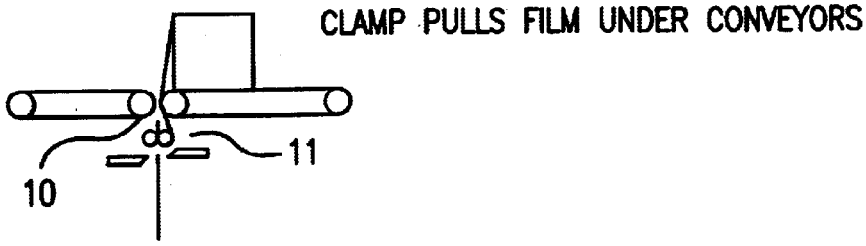
FIG. 7 shows the clamp pulling the film below the conveyors
Figure 8:
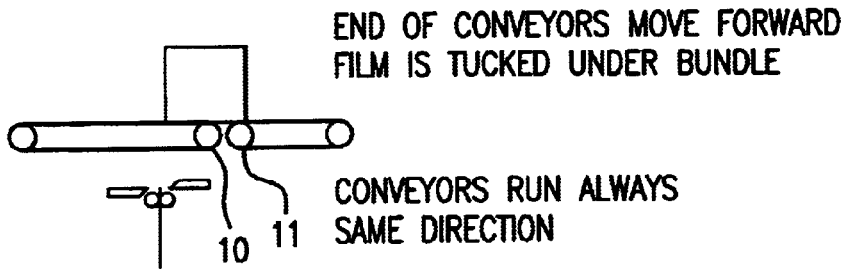
FIG. 8 shows the first conveyor moving forward to pinch the released end of the film under the article to create an overlap.

FIGS. 5–8 show an alternative embodiment for wrapping an article. Article 8 moves from conveyor A to B. FIG. 5 shows clamp 2 pulls film 6 from below the conveyors through an opening between conveyors A and B so the article 8 can intercept film 6. After clamp 2 pulls film 6 to a height that would allow the article 2 to be wrapped and the ends of the film to be overlapped shear 7 cuts the film. FIG. 6 shows the movement of article 8 to conveyor B having the cut end of film 6 pinched between the conveyor A and the bottom of the article 8. FIG. 7 shows clamp 2 wrapping the article 8 by moving through the opening between conveyors A and B. After reaching a position below the conveyors the film 6 is released. The conveyors can stop to allow clamp 2 time to move below the conveyors. FIG. 8 shows the front pulley 10 of conveyor A and the back pulley 11 of conveyor B moving forward. This movement causes the released end to be tucked or pinched underneath article 8 so that an overlap is created between the released end and the cut end. This overlap is heat sealed at a, later station As article 2 moves along conveyor B the pulleys 10 and 11 are moved back to their original position. At this time clamp 2 moves film 6 to the position in FIG. 5 to wrap the next article moving on conveyor A. Clamp 2 can seize the film by moving through an opening between having the blades of the shear. FIG. 8 shows clamp 2 seizing film 8 below the shear 7.

Figure 9:
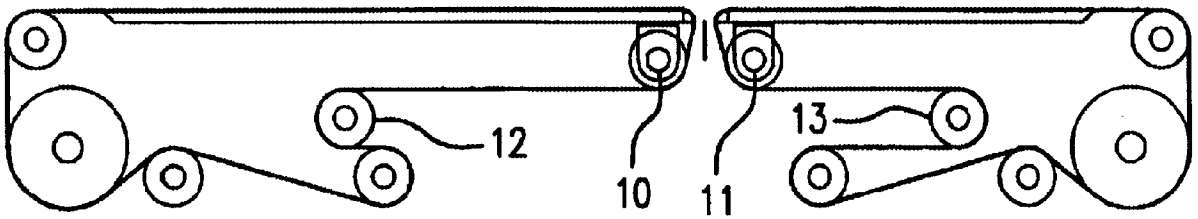
FIG. 9 shows two conveyors with movable pulleys to extend or decrease the length of a conveyor.
Figure 10:
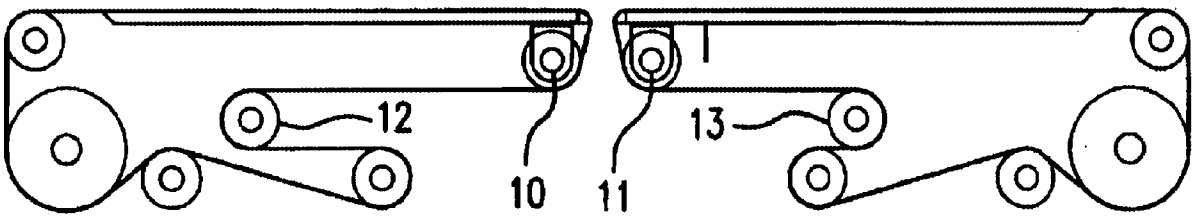
FIG. 10 shows the two conveyors in FIG. 9 with movable pulleys moved to a different position to extend or decrease the length of a conveyor.

FIGS. 9 and 10 shows pulleys 10 and moving the first and second conveyors to different positions. This is accomplished by moving pulleys 12 and 13 in synchronization with pulleys 11 and 12.

Figures 11, 12:
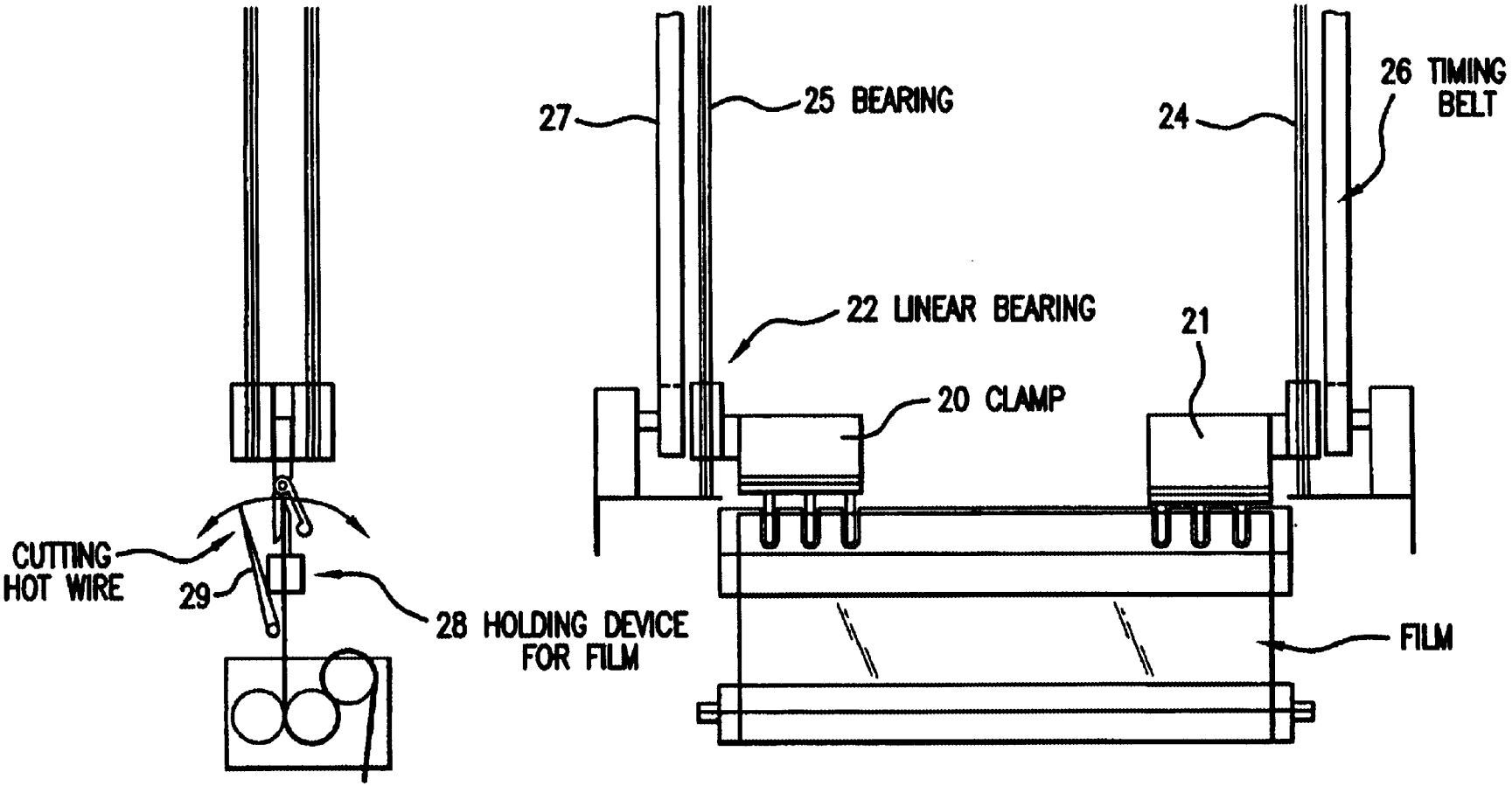
FIG. 11 shows the film being pulled from a holding device.
FIG. 12 shows the clamps being moved by timing belts to synchronize the movement of their movement with the article and the conveyors.
Figure 13:
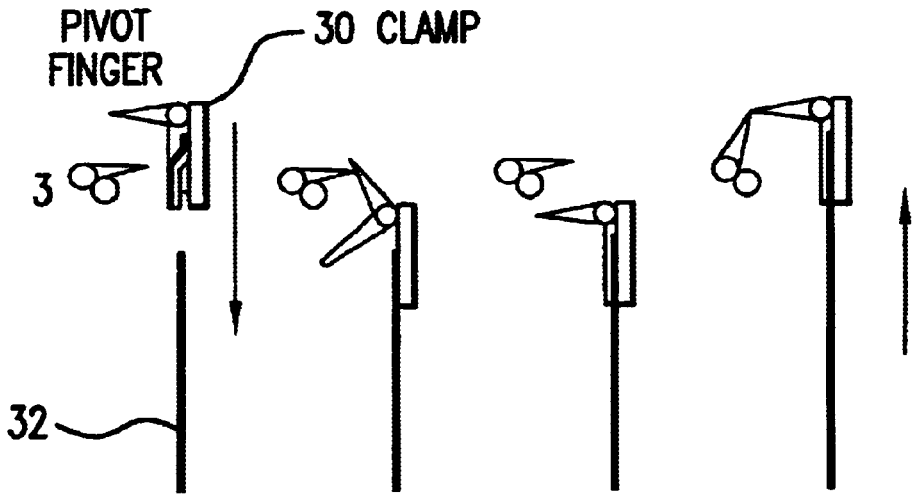
FIG. 13 shows a pivot finger opening the clamp

The clamping of the film is shown in FIGS. 11, 12 and 13. FIGS. 11 and 12 show a clamps 20 and 21 attached to linear bearings 22 and 23 moving up and down on bearing 24 and 25. The clamps are driven by a pair of timing belts 26 and 27 to synchronize the movement of the clamps to the conveyor and the article to be wrapped. FIG. 13 shows the operation of pivot finger 31 that opens the clamp 30 as the clamp moves down to seize the film 32.

The second embodiment allows for a continuous movement without the need for the article to move back and forth as in the first embodiment. This allows for faster processing speeds.

A third embodiment is to have the conveyors A and B reverse direction after the position in FIG. 8 and after the film is released by the clamp. Reversing the direction causes the released end of the film to be tucked under the article. The conveyors move in the reverse direction for a sufficient amount of time to achieve an overlap that can be heat-sealed. During this operation the conveyors move at substantially the same speed. The movement of the clamp is synchronized with the movement of the conveyors to insure that the film moves to the desired locations. This embodiment allows for the conveyor to move continuously without stopping.

The particular structure to accomplish the movement of the conveyors, the clamp, the feeding of the film to the clamp can be accomplished using conventional techniques in the art. For example, the clamp can be fixed on a pair of timing belts that would synchronize movement of the clamp to the position of the conveyors and article and the opening of the blades of the shear

What is claimed is:

1. An apparatus for wrapping articles comprising;

a clamp for pulling a film a first conveyor for moving an article to a second conveyor a second conveyor an opening between the first and second conveyor sufficient to allow the clamp to pull the film through the opening, a shear located below the first and second conveyors means for feeding an end of the film to said clamp means for seizing the end of the film by the clamp below the conveyors, means for pulling the film by moving the clamp with the seized end of the film through the opening to a position above the conveyors that would allow the film to wrap the article with an overlap, means for cutting the film with the shear after the clamp is reached said position, means for wrapping the article by moving the clamp with the seized film from said position through said opening to a second position below the conveyors and releasing said seized film, means for overlapping the cut end and released end of the film wherein the overlap is between the conveyor and the bottom of the article.

2. An apparatus according to claim 1 wherein the means for overlapping includes means for moving an article from the second conveyor back to the first conveyor so that the article can intercept the film pulled by the clamp to the first position thereby pinching the cut end (portion) of the film between the conveyor and the bottom of the article and moving the article back to the second conveyor to overlap the film.

3. An apparatus according to claim 1 wherein the means for overlapping includes means for moving the article from the first conveyor to the second conveyor so that the article intercepts the film seized by the clamp and means for moving the clamp through the opening to wrap the film and then release the film below the conveyors and then moving the front pulley of the first conveyor and and the back pulley opf the second conveyor forward inorder to overlap the film.

4. An apparatus according to claim 2 wherein the shear has blades and wherein the means for moving the clamp below the conveyor includes means for moving the clamp between the opening of the blades to seize the film being fed to the clamp.

5. An apparatus according to claim 2 wherein the shear has blades and wherein the means for moving the clamp below the conveyor includes means for moving the clamp between the opening of the blades to seize the film being fed to the clamp.

6. An apparatus according to claim 1 including means for heat sealing the overlapped film.

7. An apparatus according to claim 6 including a heat shrink tunnel.

8. An apparatus according to claim 1 wherein the means for overlapping includes means for moving the article from the first conveyor to the second conveyor so that the article intercepts the film seized by the clamp and means for moving the clamp through the opening to wrap the film and then release the film below the conveyors and then reversing the conveyors causing the released film end to overlap the film.

9. A process for wrapping articles comprising;

moving an article from a first conveyor to a second conveyor having an opening between the first and second conveyor sufficient to allow a clamp to pull a film through the opening, feeding an end of the film to a clamp seizing the end of the film by the clamp below the conveyors pulling the film by moving the clamp with the seized end of the film through the opening to a position above the conveyors that would allow the film to wrap the article with an overlap, cutting the film with a shear located below the first and second conveyors after the clamp is reached said position, wrapping the article by moving the clamp with the seized film from said position through said opening to a second position below the conveyors and releasing said seized film, and overlapping the cut end and released end of the film wherein at least a portion of the overlap is between the conveyor and the bottom of the article.

10. An process according to claim 9 wherein overlapping includes moving an article from the second conveyor back to the first conveyor so that the article can intercept the film pulled by the clamp to the first position thereby pinching the cut end of the film between the conveyor and the bottom of the article and moving the article back to the second conveyor to overlap the film.

11. A process according to claim 9 wherein the overlapping includes moving the article from the first conveyor to the second conveyor so that the article intercepts the film seized by the clamp and moving the clamp through the opening to wrap the film and then release the film below the conveyors and then moving the front pulley of the first conveyor and the back pulley of the second conveyor forward thereby overlapping the film.

12. A process according to claim 9 wherein the overlapping includes moving the article from the first conveyor to the second conveyor so that the article intercepts the film seized by the clamp and moving the clamp through the opening to wrap the film and then release the film below the conveyors and then reversing the conveyors causing the released film end to overlap the film.

13. A process according to claim 9 wherein the shear has blades and the clamp is moved below the conveyors between the opening of the blades to seize the film being fed to the clamp.

14. A process according to claim 10 wherein the shear has blades and the clamp is moved below the conveyor between the opening of the blades to seize the film being fed to the clamp.

15. A process according to claim 9 including heat sealing the overlapped film.

16. A process according to claim 9 including heat shrinking the film.

17. A process according to claim 9 wherein the conveyors move at substantially the same speed.

* * * * *